US006218780B1

(12) United States Patent
Ehrlichmann et al.

(10) Patent No.: US 6,218,780 B1
(45) Date of Patent: Apr. 17, 2001

(54) HIGH-PRESSURE DISCHARGE LAMP WITH A COOLED ELECTRODE

(75) Inventors: Dietmar Ehrlichmann, Berlin; Dieter Franke, Munich, both of (DE)

(73) Assignee: Patent-Truehand-Gesellschaft fuer elektrische Gluelampen mbH (DE)

( * ) Notice: Subject to any disclaimer, the term of this patent is extended or adjusted under 35 U.S.C. 154(b) by 0 days.

(21) Appl. No.: 09/103,780

(22) Filed: Jun. 24, 1998

(30) Foreign Application Priority Data

Jul. 9, 1997 (DE) ..... 197 29 219

(51) Int. Cl.[7] ..... H01J 17/04; H01J 61/04

(52) U.S. Cl. ..... 313/631; 313/30; 313/22; 313/35

(58) Field of Search ..... 313/623, 631, 313/632, 630, 30, 31, 32, 42, 22, 17, 18, 35, 39

(56) References Cited

U.S. PATENT DOCUMENTS

| | | | | |
|---|---|---|---|---|
| 3,043,972 | * | 7/1962 | Laszio | 313/32 |
| 3,311,769 | * | 3/1967 | Schmidtlein | 313/32 |
| 3,412,275 | | 11/1968 | Thouret et al. | 313/32 |
| 3,531,673 | | 9/1970 | Paquette | 313/32 |
| 3,636,401 | * | 1/1972 | Cortorillo et al. | 313/352 |
| 3,685,475 | | 8/1972 | Banks | 113/120 |
| 3,816,784 | * | 6/1974 | Weninger | 313/32 |
| 5,633,556 | * | 5/1997 | Fujina et al. | 313/32 |

FOREIGN PATENT DOCUMENTS

| | | | |
|---|---|---|---|
| 2236973 | 8/1973 | (DE) | H01J/61/12 |
| 3527855 | 8/1986 | (DE) | H01L/21/32 |

* cited by examiner

*Primary Examiner*—Nimeshkumar D. Patel
*Assistant Examiner*—Michael J. Smith
(74) *Attorney, Agent, or Firm*—William H. McNeil

(57) ABSTRACT

Each electrode comprises a shaft (6) and a head (5), the shaft being sealed in a vacuum-tight fashion in each case in an end region (2, 22) of the discharge vessel. At least one electrode is cooled by virtue of the fact that its shaft contains a cooling tube system in which a coolant (11) circulates. Said cooling tube system is surrounded at a spacing by an additional enveloping tube (9, 16), the interspace (10, 20) between the enveloping tube and cooling tube system being fitted with a means of thermal insulation.

13 Claims, 5 Drawing Sheets

HIGH-PRESSURE DISCHARGE LAMP WITH A COOLED ELECTRODE

TECHNICAL FIELD

The invention proceeds from a high-pressure discharge lamp with a cooled electrode in accordance with the preamble of claim 1. At issue here, in particular, are high-power mercury high-pressure discharge lamps, but also other metal vapour lamps, in particular metal halide lamps as well as inert gas high-pressure discharge lamps, in particular xenon high-pressure lamps.

PRIOR ART

U.S. Pat. No. 3,636,401 has already disclosed a high-pressure discharge lamp with a liquid-cooled electrode, in which the electrode shaft is a tube in which a cooling liquid circulates. An inner tube of small diameter, in which the cooling liquid is transported to the tip of the electrode, is concentrically surrounded by an outer tube of larger diameter, in which the cooling liquid flows back again.

It was recognized very early that the application of liquid-cooled electrodes, particularly in the case of metal-vapour lamps (mercury high-pressure discharge lamps), and possibly also in the case of metal halide lamps and inert gas high-pressure lamps, requires careful design of the electrode so that the temperature at the electrode head does not become too high. In the case of metal-containing lamps, on the other hand, the temperature at the electrode shaft is not permitted to become too low (because of the risk of condensation). U.S. Pat. No. 3,412,275 describes an electrode in which at the shaft the wall of the outer tube is so thin that the lamp current, which flows via the outer tube acting as electrode shaft, gives rise to additional resistance heating. In addition, the shaft tube feeding the cooling water is lined on the inside with a material of low thermal conductivity (ceramic, quartz). The electrode head is cooled in this way and, on the other hand, the cooling effect in the shaft region of the electrode is limited such that no undesired condensation of mercury can take place. The electrodes are sealed by means of a transitional glass seal with Kovar cups, the seal having a constriction for centring the electrode shaft which, however, does not seal the seal region situated therebehind in a vacuum-tight fashion. Part of the filling therefore diffuses into the region of the transitional glass seal. The disadvantage is the high energy consumption owing to the resistance heating and the low thermostability of such a seal. Furthermore, there is a risk of the formation of cracks and fissures in the region of the seal, with the result that cooling water can come into contact with hot points and start to boil.

DESCRIPTION OF THE INVENTION

It is the object of the present invention to provide a high-pressure discharge lamp in accordance with the preamble of claim 1 which is very powerful and permits a high radiant flux.

This object is achieved by means of the characterizing features of claim 1. Particularly advantageous refinements are to be found in the dependent claims.

In principle, the present invention can be applied to inert gas high-pressure discharge lamps, but is chiefly suitable for mercury-containing lamps, in particular. The present invention may be used particularly advantageously for lamps with a short electrode spacing (a few millimeters up to a few centimeters) (so-called short-arc lamps). Mercury short-arc lamps are limited in their power density, because the fusing and vaporization of the electrode material sets a limit on the maximum achievable power density in the discharge arc. The present invention is particularly important for DC lamps, since here the anode is heated particularly intensely (distinctly more intensely than the cathode). However, it can also be used with AC lamps.

The simultaneous requirement for a high radiant flux and small spectral line widths of the mercury lines (in particular the i-line at 365 nm) can be satisfied only with a high current density in the discharge arc. The anode is particularly intensely heated by the work of electrons captured there.

By virtue of the liquid cooling of electrodes, it is possible to realize substantially more powerful lamps (up to more than 10,000 W) than when use is made of conventional electrodes, whose cooling is based on emission and convection.

It is particularly to be borne in mind in the case of mercury high-pressure lamps that the temperature is not permitted to be below the condensation temperature of the mercury at any point in the interior of the discharge vessel. In the present invention, this problem is solved by a particularly effective thermal insulation of the feeding and return of the coolant.

This is achieved by virtue of the fact that the cooling tube system, comprising a feed tube and return tube, is insulated with the aid of an external enveloping tube. Located between the enveloping tube and cooling tube system is an interspace which is evacuated or filled with a thermally insulating medium.

By comparison with U.S. Pat. No. 3,412,275, this solution is simpler, cheaper and more effective. The point is that instead of a watertight inner lining resistant to high temperatures, use is now made of an external enveloping tube which is simpler to produce and to process. Said solution exhibits a better insulating effect. Moreover, there is no need for resistance heating (caused by the lamp current), since the insulation is so effective owing to the enveloping tube that is sufficient on its own reliably to prevent condensation of the filling (mercury). A minimum temperature of approximately 300° C. is thereby ensured for the surface of all the parts in the lamp interior, even if a cooling tube system with substantially cooler coolants (a typical temperature being 20–40° C.) is located in the electrode shaft. The temperature of the coolant can be at most approximately 120° C., since there is a risk of bursting above that temperature. Below 20° C. there is the risk of condensation of atmospheric moisture. Operation with antifreeze-containing water as coolant is possible with xenon lamps down to −40° C.

In detail, the high-pressure discharge lamp according to the invention has a discharge vessel and two electrodes arranged therein. The electrodes respectively comprise a shaft and a head, the shaft being sealed in a vacuum-tight fashion in each case in an end region of the discharge vessel. At least one electrode (the anode in the case of DC lamps, in particular) is cooled by virtue of the fact that its shaft contains a tube system in which a liquid or a gas circulates. Said shaft tube is surrounded at a spacing by an additional enveloping tube, the interspace between the enveloping tube and shaft tube being fitted with a means of thermal insulation.

The means of thermal insulation is advantageously a vacuum or a medium of low thermal conductivity, in particular a suitable gas filling, for example, argon or nitrogen. Additionally or alternatively, a medium, such as mineral wool or ceramic felt, which reduces the convective heat transport is inserted into the interspace of the enveloping tube.

The enveloping tube itself advantageously consists of molybdenum, since because of its high melting point said material can be processed effectively with quartz glass (silica glass) and, moreover, has a high resistance to possible aggressive or corrosive filling constituents (sodium vapour, metal halide). However, other materials such as, for example, niobium, copper (possibly coated), tantalum or nickel or their alloys can also be used. The particular advantage of molybdenum is, however, that it does not form a compound (amalgam) with mercury.

In one embodiment, the enveloping tube consists, at least predominently of hard glass or silica glass. In a particularly preferred embodiment, the enveloping tube is partially formed by the end region of the discharge vessel. The connection between the enveloping tube and the shaft is advantageously then performed by a molybdenum cap seal or transitional glass seal. The principle of a seal with molybdenum caps is disclosed, however, in U.S. Pat. No. 3,685,475 and DE-A 2 236 973. The technique using Kovar cups and transitional glasses is described, for example, in U.S. Pat. No. 3,636,401.

In a second embodiment, the enveloping tube consists of metal. In this case, the enveloping tube is preferably designed as an external part of the shaft.

A longer service life and higher operating safety of the molybdenum cap seal in the case of increased operating temperatures is advantageously achieved by means of a second seal (molybdenum cap seal/O-ring seal/bonding) which relieves the first seal. The second seal prevents oxygen passing from the air to the rear of the metal parts of the first, relatively hot seal. A vacuum or protective gas (argon, nitrogen) is introduced between the first and second seal for this purpose.

In addition, the pressure on the first seal can be relieved by gas at a pressure between that in the discharge vessel and the atmospheric pressure being located between the two seals. This applies, chiefly, to xenon high-pressure lamps, which have a particularly high pressure in the discharge vessel.

A particular advantage of the use of the present invention in the case of xenon high-pressure discharge lamps is that undesired dead volumes are avoided by the molybdenum cap seal. Said volumes would lead to an increased arc instability. Moreover, the novel technique permits reduction in the filling pressure, as a result of which the lamp starts more easily. Finally, there is only one soldered joint, specifically between the anode head and molybdenum cap, which must be completely vacuum-tight. The enveloping tube made from glass then protects the vacuum integrity of the lamp bulb against microscopic leaks in the cooling tube system.

A preferred field of application for cooled high-power mercury high-pressure discharge lamps is photolithography, in particular for exposing wafers (DE-A 35 27 855). In this case, the radiation must be generated in a volume which is as punctiform as possible, corresponding to a very short discharge arc (short-arc lamp). Only then can the optical system required in this case make optimum use of the radiation. Increasing the irradiance and thereby shortening the exposure time of the wafer can therefore be done only via raising the radiation density in the discharge arc of the lamp, corresponding to an increase in power. However, without cooling, said increase quickly leads to melting and vaporization of the material on the surface of the electrode. The anode is particularly affected by this.

Water is normally used as the cooling medium. However, oil, in particular silicone oil, or the oil known from heat exchangers (for example Farolin), or gas (inert gas such as argon or nitrogen) is also suitable. Oil has the advantage of not being corrosive and also of not calcifying. Finally, an operating temperature of up to approximately 200° C. can be realized using oil.

Although gases have a low thermal capacity per volume, they permit operating temperatures which are impossible with water because of the high vapour pressure. When gases are used, the permissible increase in temperature of the coolant is no longer limited, as with a liquid, when the boiling point is reached.

Normally, a coaxial arrangement of the cooling liquid tubes is selected, the feed tube being arranged on the inside and the return tube on the outside (as a jacket surrounding the feed tube). However, instead of a coaxial arrangement it is also possible to arrange two tubes the same diameter next to one another in an enveloping tube for the feed and return, or to arrange a single tube with an axial partition.

A suitable power range for mercury high-pressure lamps is between 3000 and 10,000 watts. Currents of over 100 A are achieved in this case (for example up to 300 A). With xenon high-pressure lamps, power ranges are preferably between 5000 and 30,000 watts. Typical operating temperatures are between 250 and 600° C. The upper limit is approximately 900° C. It is given by the thermostability of the molybdenum caps.

The temperature of the cold spot in the lamp interior can be increased to more than 600° C. given careful insulation. This permits the use of halides, and thus the construction of high-power metal halide lamps.

BEST MODE FOR CARRYING OUT THE INVENTION

Figure 1:
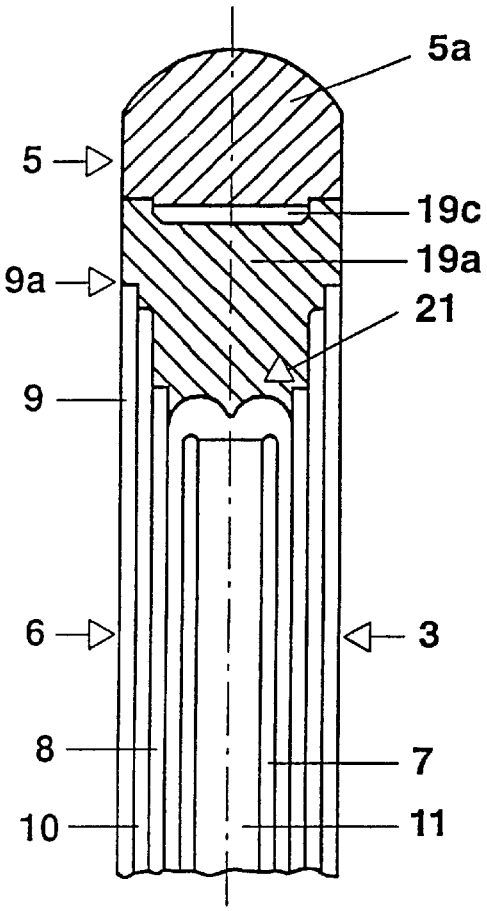
FIG. 1 shows an anode for a mercury short-arc lamp.
Figure 2:
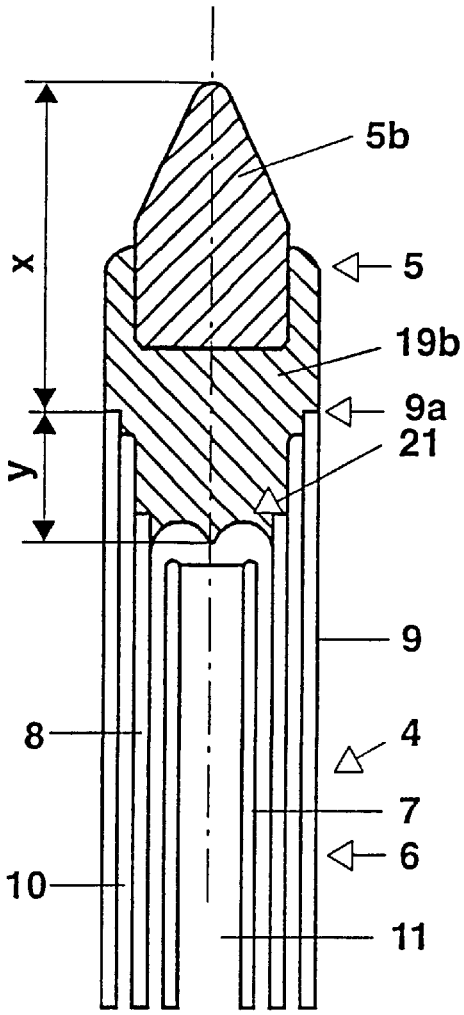
FIG. 2 shows a cathode for a mercury short-arc lamp.

A mercury short-arc lamp operated using direct current includes an anode 3 (FIG. 1) and a cathode 4 (FIG. 2), which are arranged opposite one another. The two electrodes 3, 4 comprise a head 5, which faces the discharge and is made from tungsten (or another heat-resistant (sintered) material such as molybdenum, niobium or tantalum) and a shaft 6 attached thereto. The head of both electrodes respectively comprises a basic body 19*a, b* and a tip 5*a, b* inserted therein. The shaft 6 of the electrodes normally heats up during operation of the lamp, specifically owing to the heating of the electrode material itself, the hot filling and the radiation.

The two electrodes 3, 4 are water-cooled. The shaft 6 is designed in each case as a cooling tube system for this purpose. An axial tube situated on the inside serves as feed tube 7 of a coolant. It is surrounded by a coaxial tube of larger diameter, which serves as return tube 8 by producing a coaxial annular gap around the feed tube. The feed tube 7 is open on the discharge side towards the return tube 8. The coolant 11 is deflected at the rear wall 21 of the basic body towards the return tube 8. A liquid 11 (water) can circulate in this way in the shaft of each electrode.

The return tube 8 is surrounded at a spacing by an enveloping tube 9. The connection of the shaft tubes 7, 8, 9 to the basic body 19 of the electrodes is effected by electron beam welding, laser welding or high-temperature soldering (for example platinum). The enveloping tube 9 is fabricated from molybdenum. It is a constituent of the shaft 6 and determines the outside diameter thereof. The wall thickness of the three tubes is approximately 1 mm in each case. The outside diameter of the feed tube 7 (made from stainless steel) is approximately 6 mm, that of the return tube 8 (made from molybdenum) is approximately 10 mm, and that of the enveloping tube 9 is approximately 14 mm.

Located in the interspace 10 between the enveloping tube 9 and return tube 8 is approximately 700 mb of argon. However, it is also possible to use a vacuum. The length of the enveloping tube is approximately 80 mm. The water 11 circulates at a rate of approximately 1 to 5 l/min in the feed and return tubes 7, 8.

In the case of the cathode 4 (FIG. 2), the cooled basic body 19*b* carries the actual tip 5*b* and is in intimate thermal contact therewith. The entire head is thus cooled.

The basic body 19*a* on the anode (FIG. 1) is thermally separated from the tip 5*a* by a transverse gap 19*c* which forms a cavity inside the anode head 5. Said gap impedes the flow of heat near the axis from the tip 5*a* to the basic body 19*a* and displaces it more to the periphery. The surface of the anode thereby becomes hotter. The point of attachment of the enveloping tube 9 to the basic body 19*a* is therefore at a higher temperature, and the enveloping tube 9 becomes hotter owing to thermal conduction. The gap 19*c* can be necessary in order to raise the temperature of the enveloping tube above 300° C. The temperature can be controlled by the length of the gap 19*c*.

The temperature distribution of the cathode has a maximum at the tip 5*b* and a minimum in the region of the rear wall 21 of the basic body, which adjoins the coolant. The temperature drops continuously therebetween. The temperature of the cold spot of the lamp, that is to say the coldest point which is accessible to the lamp filling, can be varied by attaching the enveloping tube 9 at a different level on the basic body. The spacing of the point of attachment 9A of the enveloping tube on the actual tip of the cathode may be denoted by x and the residual length up to the rear wall by y (see FIG. 2). The temperature of the cold spot decreases with increasing spacing x of the point of attachment of the enveloping tube from the peak, and with an increasing ratio x/y (compare FIG. 2). The sum x+y is the total length of the head 5. This consideration likewise holds, of course, for the anode.

Figure 3:
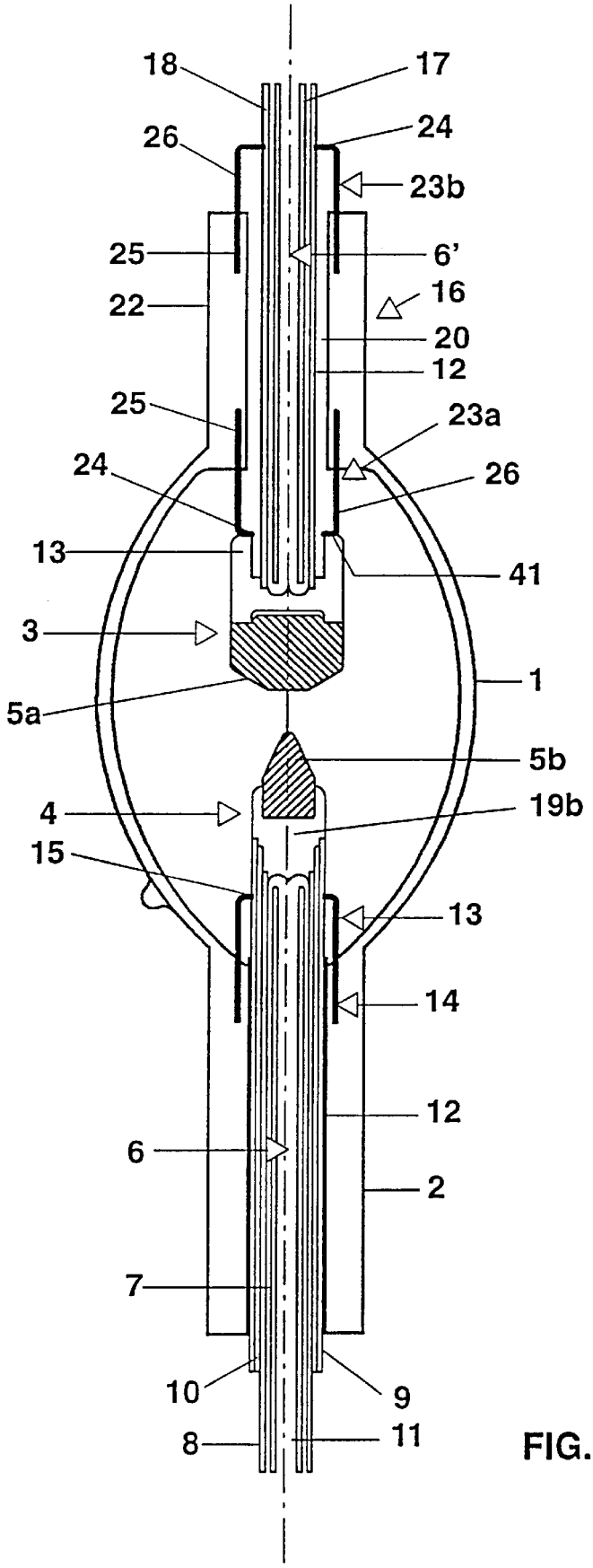
FIG. 3 shows a mercury short-arc lamp.

A mercury short arc lamp operated using direct current and having a power of 6000 W is represented in FIG. 3. It comprises a discharge vessel 1 made from silica glass, whose two end regions are designed as seals 2, 22. Similar to the way described above, an anode 3 and a cathode 4 are arranged opposite one another in the discharge vessel. The two electrodes 3, 4 comprise a head 5, made from tungsten (or another heat-resistant material) and facing the discharge, and a shaft 6 attached thereto. The shafts of the anode 3 and the cathode 4 are sealed in a vacuum-tight fashion in the end regions 2, 22.

A molybdenum foil 12 is wound around the enveloping tube 9 of the cathode. The molybdenum foil 12 prevents the silica glass of the end region from combining with the molybdenum tube. The different thermal expansion coefficients of the two materials would otherwise lead to cracks in the silica glass. For the purpose of vacuum-tight sealing, on the discharge side a pot-shaped molybdenum cap 13 is seated on the shaft 6 such that its open end 14 is sealed in a vacuum-tight fashion with the end region 2. The base part 15 of the cap 13 is soldered to the enveloping tube 9.

Apart from the gap 19*c* and the blunt head 5, the anode 3 is of similar construction to the cathode 4. The diameter of the anode head 5 is, however, distinctly larger than that of the shaft 6'. The latter comprises only the cooling tube system, but no integrated enveloping tube. The cooling tube system comprises the feed tube 17 and the return tube 18.

A double molybdenum cap seal is used for the purpose of sealing the anode in a vacuum tight fashion in the discharge vessel, which is made from silica glass. In this arrangement, each molybdenum cap 23*a,b* is soldered in a vacuum-tight fashion to the return tube 18.

The enveloping tube 16 of the anode 3 is separately formed. It comprises to a substantial extent the circular cylindrical end region 22, surrounding the anode at a spacing, of the discharge vessel. The end parts of the enveloping tube are formed by the side walls of the molybdenum caps. The shaft 6 of the anode is formed only from the coaxial feed and return tube 17, 18. The wall thickness of the two tubes 17, 18 is 1 mm, in each case, and the end region 22 is approximately 5 mm. The outside diameter of the feed tube 17 is 6 mm, and that of the return tube 18 is 10 mm. The outside diameter of the end region 22 is 28 mm.

There is a vacuum in the interspace 20 between the end region 22 and return tube 18. The length of the end region 22 is approximately 90 mm. The water 11 circulates at a rate of approximately 5 l/min in the feed and return tubes 17, 18.

The vacuum-tight seal of the anode 3 is achieved by virtue of the fact that two pot-shaped molybdenum caps 23 produce a connection between the end region 22 and anode 3. The first cap 23*a,* which is near the discharge, is attached with its base part 24 directly behind the basic body 19 of the anode on the rear wall 41 of said basic body. In this arrangement, its open end 25 is sealed into the end region 22. The base part 24 of the cap is connected to the rear wall 41 by means of a metal solder known per se (silver-copper-palladium).

The second cap 23*b,* which is remote from the discharge, is soldered with its base part 24 outside the discharge vessel to the return tube 18, and projects with its free end 25 into the outer end of the end region 22. The free end is sealed there. Thus, together with the end region 22 of the discharge vessel the two caps 23*a* and 23*b* form the enveloping tube 16 for the anode 3. The side wall 26 of the caps 23 is thus an end part of the enveloping tube in each case. The interspace towards the return tube 18 is evacuated.

Figure 4:
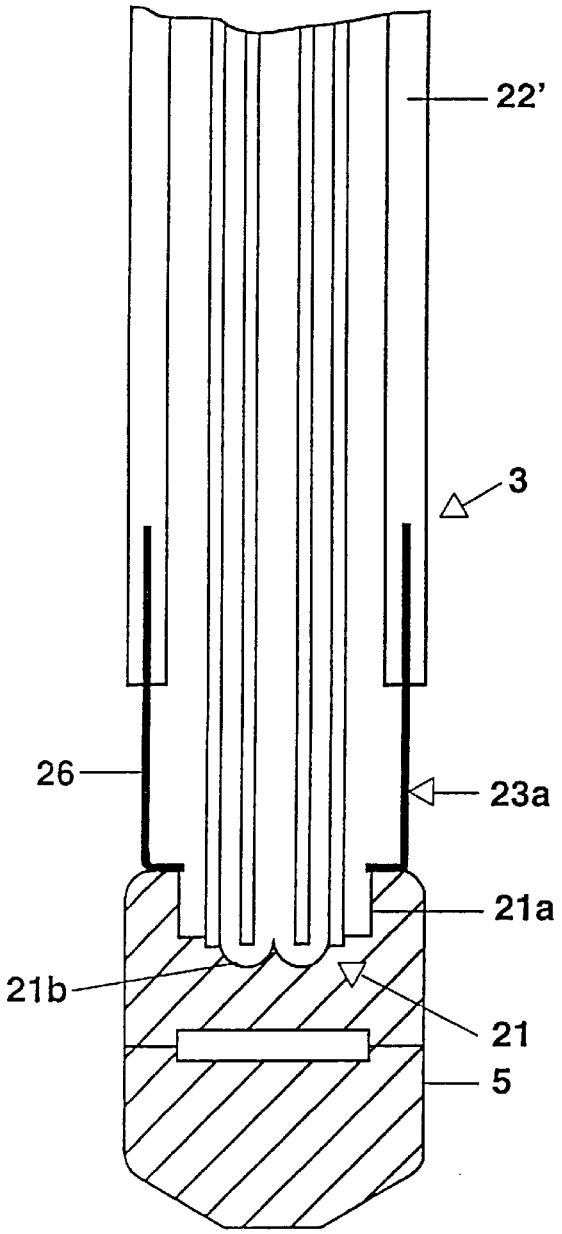
FIG. 4 shows the anode of a lamp from FIG. 3, in detail.

This arrangement is shown once again in detail in FIG. 4 before sealing in the vessel end. The contour of the rear wall 21 of the anode tip is shaped such that it forms side walls 21*a* for the enveloping tube and deflecting arcs 21*b* for the feed and return. The molybdenum cap is initially sealed into a short silica glass tube 22' which is later fused with the end region of the discharge vessel.

During operation of the lamp, the enveloping tube assumes a temperature which is so high that condensation of the mercury on the enveloping tube or parts thereof situated in the discharge vessel (here, chiefly the side wall 26 of the molybdenum cap near the discharge) is avoided.

Figure 5:
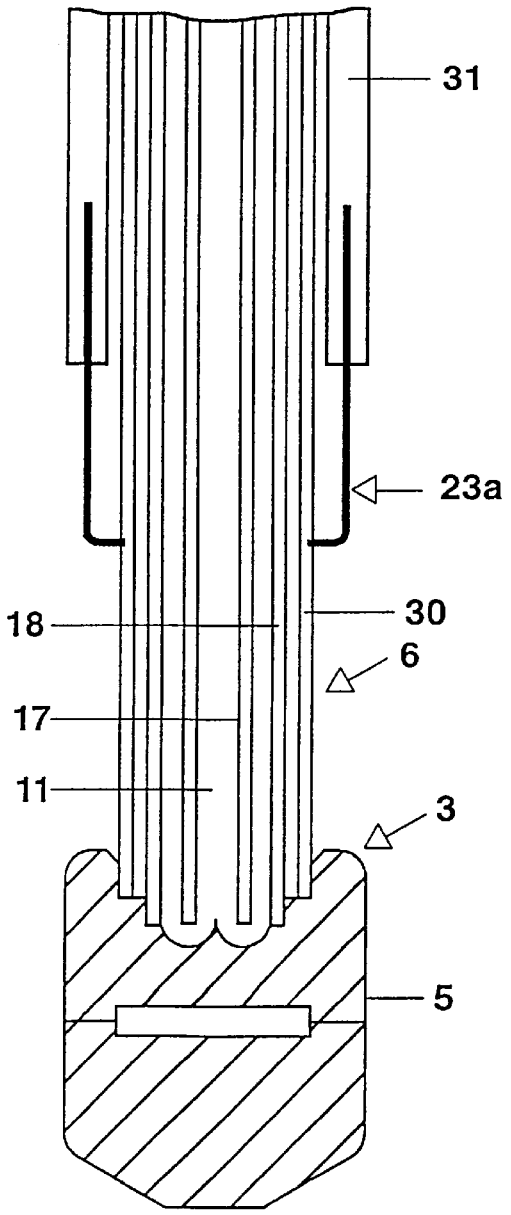
FIG. 5 shows a further exemplary embodiment of an anode, in detail.

A further exemplary embodiment of an anode 3 is shown in FIG. 5. By contrast with FIG. 4, the enveloping tube 30 is designed as a metallic external part of the shaft 6 of the electrode. The cap 23*a* near the discharge, which, just like the silica glass tube 31, is not part of the enveloping tube here, is soldered not on the tip of the anode but, in a manner similar to in the case of the cap 23*b* remote from the discharge (FIG. 3), on the enveloping tube 30. The length of the enveloping tube can thereby be influenced or shortened. The design of this arrangement for the anode corresponds in principle to that from FIG. 1.

Figure 6:
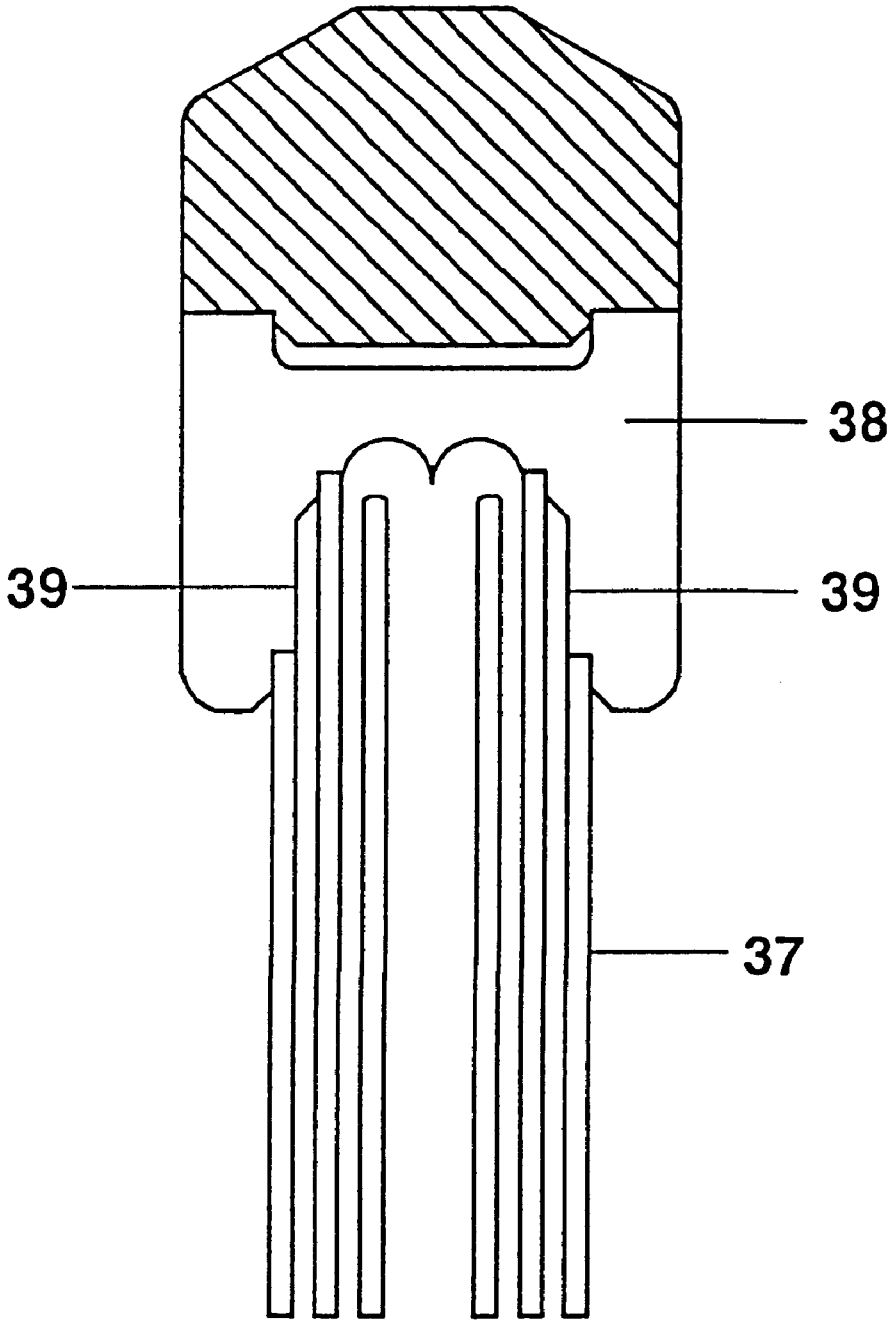
FIG. 6 shows a further exemplary embodiment of an anode, in detail.

In a further exemplary embodiment of the anode (FIG. 6), the basic body 38 of the anode partly takes over the function of the enveloping tube 37 attached further behind. The tube system penetrates deeply into the basic body 38. The foremost part of the enveloping tube 37 is missing, and is formed by the appropriately configured side wall 39 of the basic body.

Figure 7:
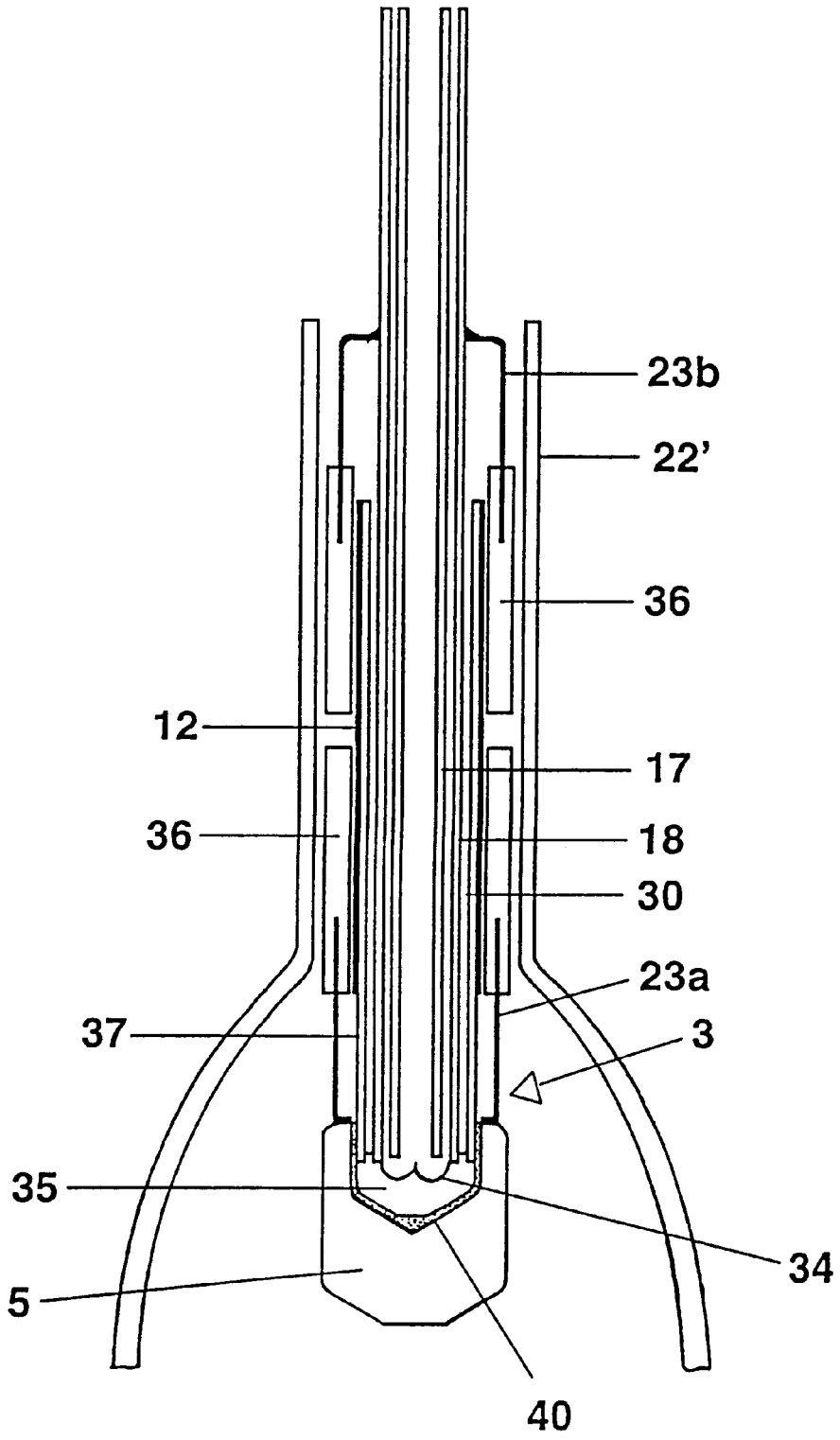
FIG. 7 shows a further exemplary embodiment of an anode, in detail.

A further exemplary embodiment of a lamp is shown in section in FIG. 7. In this arrangement, the electrode system is firstly inserted into the end region 22', but not yet fused therewith. The difference with respect to FIG. 3 consists in that the discharge-side end of the three tubes 17, 18, 30 does not terminate directly at the tip 5 of the anode, but that a separate cover part 35 made from solid molybdenum is attached in the interior of the anode tip 5 to deflect the flow. It connects the feed and return tubes 17, 18 by means of a deflecting arc 34 at its rear. The cover part 35 is thermally connected to the one-piece anode head by a metal solder 40. In this exemplary embodiment, the cathode (not shown) is a conventional cathode without liquid cooling. It was possible using this exemplary embodiment to permit a high current flow of approximately 260 A in the case of a 6500 W mercury short-arc lamp with an electrode spacing of 4.5 mm, given a constant power in the i-line of the mercury (365 nm) of approximately 120 W.

FIG. 7 shows that the first step in producing the lamp is to insert into the end region 22' an electrode system comprising the anode 3 and the molybdenum caps 23 including two short silica glass tubes 36. The silica glass tubes 36 are separated from the enveloping tube by a molybdenum foil 12. Only then is the end region 22' fused with the silica glass tubes 36, thus producing a thickened end region 22, as in FIG. 3.

What is claimed is:

1. High-pressure mercury discharge lamp having a discharge vessel (1) and two electrodes (3, 4) arranged therein, each electrode comprising a shaft (6) and a head (5), the shaft being sealed in a vacuum-tight fashion in each case in an end region of the discharge vessel, and at least one electrode being cooled by virtue of the fact that its shaft contains a cooling tube system in which a coolant (11) circulates, characterized in that said cooling tube system is surrounded at a spacing by an additional enveloping tube (9, 16) that is separated from the discharge volume of the discharge vessel, the interspace (10, 20) between the enveloping tube and cooling tube system being endowed with a means of thermal insulation.

2. High-pressure discharge mercury lamp according to claim 1, characterized in that the cooling tube system alone forms the shaft of the electrode.

3. High-pressure discharge mercury lamp according to claim 1, characterized in that the enveloping tube is a constituent of the shaft.

4. High-pressure mercury discharge lamp according to claim 1, characterized in that the means of thermal insulation is a vacuum or a medium of low thermal conductivity.

5. High-pressure discharge mercury lamp according to claim 1, characterized in that the enveloping tube (9, 16) consists of hard glass or silica glass.

6. High-pressure discharge mercury lamp according to claim 3, characterized in that the enveloping tube (16) is formed at least partially by the end region (22) of the discharge vessel.

7. High-pressure discharge mercury lamp according to claim 3, characterized in that the connection between the enveloping tube and the shaft is made by molybdenum caps (23) or by a transitional glass seal.

8. High-pressure discharge mercury lamp according to claim 1, characterized in that the enveloping tube (30) consists of metal.

9. High-pressure discharge mercury lamp according to claim 6, characterized in that the enveloping tube (30) is designed as part of the shaft.

10. High-pressure discharge mercury lamp according to claim 1, characterized in that the lamp is operated using direct current.

11. High-pressure discharge mercury lamp according to claim 1, characterized in that the enveloping tube surrounds the shaft tube at least over the length of the end region.

12. High-pressure discharge mercury lamp according to claim 1, characterized in that the coolant is a liquid or a gas.

13. Electrode for a high-pressure discharge lamp, the electrode comprising a shaft (6) and a head (5), the shaft containing a cooling tube system in which a coolant can circulate, characterized in that said cooling tube system is surrounded at a spacing by an additional enveloping tube (9), the interspace (10, 20) between the enveloping tube and cooling tube system being fitted with a means of thermal insulation.

* * * * *